United States Patent [19]

Robertson et al.

[11] 4,296,708

[45] Oct. 27, 1981

[54] APPARATUS FOR COATING METAL SUBSTRATES WITH ADHESIVE

[75] Inventors: Kenneth L. Robertson, Covington; Curtis A. Heslep, Piqua, both of Ohio

[73] Assignee: Ken-Koat, Inc., Troy, Ohio

[21] Appl. No.: 117,693

[22] Filed: Feb. 1, 1980

[51] Int. Cl.[3] ..... B05C 1/00

[52] U.S. Cl. ..... 118/233; 118/239; 118/250; 118/260

[58] Field of Search ..... 118/233, 239, 250, 258–260, 118/249

[56] References Cited

U.S. PATENT DOCUMENTS

| | | | |
|---|---|---|---|
| 296,506 | 4/1884 | Baldwin | 118/233 |
| 2,710,590 | 6/1955 | Gerard | 118/65 |
| 2,875,724 | 3/1959 | Joa | 118/249 X |
| 3,408,984 | 11/1968 | Pullins | 118/259 |
| 3,736,903 | 6/1973 | Townsend | 118/239 X |
| 3,805,738 | 4/1974 | Kitazawa | 118/259 X |

*Primary Examiner*—Bernard D. Pianalto

*Attorney, Agent, or Firm*—Biebel, French & Nauman

[57] ABSTRACT

Metal parts are coated with one or more layers of a solvent-based adhesive using a roller coating procedure. The adhesive solution is transferred from a supply reservoir to the metal part by a natural fiber felt covered roll. The freshly coated part is then dried and the coating and drying procedure repeated until a layer of adhesive of desired thickness is built up. The use of a natural fiber felt covered roll permits uniform transfer and application of the adhesive at efficiencies above 90% (ratio of adhesive on the part to total adhesive used).

3 Claims, 5 Drawing Figures

APPARATUS FOR COATING METAL SUBSTRATES WITH ADHESIVE

BACKGROUND OF THE INVENTION

This invention relates to coating adhesives onto a substrate, and more particularly to roll coating rubber-to-metal adhesives onto a metal substrate.

In a number of industries, such as the automotive industry, the use of rubber coated metal parts in widespread. This is due not only to the resilient and damping properties of natural and synthetic rubbers, but also to their ability to coat and protect metal parts from exposure to the environment. Such rubber coated parts may find use as bushings, engine mounts, shock absorber mountings, and the like. These parts must be able to withstand such adverse environmental conditions as extreme heat and cold, salt sprays, corrosive atmospheres, chemicals, oils and solvents.

Because of the poor bonding obtained with straight rubber to metal bonds, adhesives have been developed which can bond metal parts to rubbers and withstand extremely adverse service conditions without bond failure. However, prior methods utilized to coat the metal parts, particularly hollow tubular metal parts, with adhesive are both inefficient and environmentally unsafe.

The most commonly used prior art method is spray coating in which a solvent based adhesive is sprayed from a nozzle or plurality of nozzles onto a rotating part, and the spray coated part is heated to drive off the solvent. This method is extremely inefficient in that only about 30% of the total adhesive sprayed is deposited on the part. The remaining 70% is lost or can be recovered only with great difficulty.

Moreover, since most if not all of the commercially available adhesives have a volatile organic solvent base such as benzene, toluene, xylene, methyl ethyl ketone, or methyl isobutyl ketone, their vapors must be controlled both to protect workers applying the adhesives and to comply with ambient air standards promulgated by regulatory agencies.

Likewise, dip coating of metal parts in an adhesive solution also has serious drawbacks. Dip coating is inefficient because the entire part is coated with adhesive material when in many cases only a portion of the part actually needs to be coated. Additionally, there may be a buildup of excess material on the edge of a part when it is withdrawn from the adhesive solution. This excess material may contribute to bond failure between the rubber and metal at a later time.

The use of prior brush or roller coating methods present problems of obtaining uniform coatings with no gaps or tears in the adhesive on the coated part. In many cases, the volatile solvent used in the adhesive coatings will attack and crack or embrittle rubber rollers. Use of steel rollers has not been found suitable because of transfer problems from the steel roller to the part to be coated.

Accordingly, the need exists in the art for a reliable and efficient procedure for applying a uniform adhesive coating to a metal part.

SUMMARY OF THE INVENTION

The present invention meets that need by providing an improved roller coating process in which in excess of 90% of the total adhesive used is deposited on the parts to be coated. This is achieved by the use of natural fiber felt rollers which are not adversely affected by the organic solvents utilized to suspend the adhesives used to coat the metal parts. The natural fiber felt rollers not only resist degradation by solvents but also uniformly transfer both primer and adhesive to the parts.

In a preferred embodiment of the invention, an apparatus and process are provided for roller coating hollow cylindrical metal parts with adhesive in preparation for a later bonding step to a rubber layer. The parts are automatically fed onto a series of mandrels extending from the links of an endless chain drive mechanism. Once loaded onto mandrels, the parts are passed through a series of coating and drying stations. Although any number of coating and drying stations may be utilized depending upon the part to be coated, the coating thickness desired, and types of coating being applied, in a preferred embodiment of the invention, four coating stations and a like number of drying stations are utilized.

At the first station, the mandrel with the hollow cylindrical part thereon is passed between a natural fiber felt drive wheel and an idler wheel driven in conjunction therewith. Either a primer or adhesive material is supplied to the felt wheel by means of an open-ended supply reservoir in fluid communication with the wheel. The material impregnates the felt and is then uniformly transferred to the part when the part is rolled between the drive and idler wheels. The coated part is then passed into a dryer station where a combination of heat and circulating air drives off the solvent and dries the coating.

The coating and drying procedure is repeated at subsequent stations until the desired film thickness of adhesive is built up. Depending upon the composition of the part and the type of adhesive, one or more coats of a primer may be put on the part prior to any coating of adhesive. In this case, the first one or two coating stations may be used to apply primer.

Once dry, the finished adhesively coated part is taken off the apparatus and may be either stored until needed or immediately coated with rubber. During high temperature curing of the rubber, the adhesive on the part is activated and forms a bond between the rubber and metal.

Accordingly, it is an object of the present invention to provide an efficient process and apparatus for coating metal parts with adhesive in preparation for bonding to rubber in which a uniform coating of adhesive is produced on the part with a minimum of waste. This and other objects and advantages of the invention will become apparent from the following description, the accompanying drawings, and the appended claims.

DESCRIPTION OF THE PREFERRED EMBODIMENTS

The process of the present invention may be used to coat both flat stock as well as a variety of shaped metal parts. The use of a natural fiber felt covered coating implement provides substantial advantages over prior art roller coating processes including resistance to solvent degradation and uniform transfer of adhesive. In a preferred embodiment of the invention, hollow cylindrical metal parts are coated using at least one natural fiber felt covered roller. For ease of explanation, the process and apparatus used in the present invention will be described for this preferred embodiment although it will be apparent to those skilled in the art that the apparatus described may be modified to accommodate flat stock or a variety of differently shaped parts.

Figure 1:
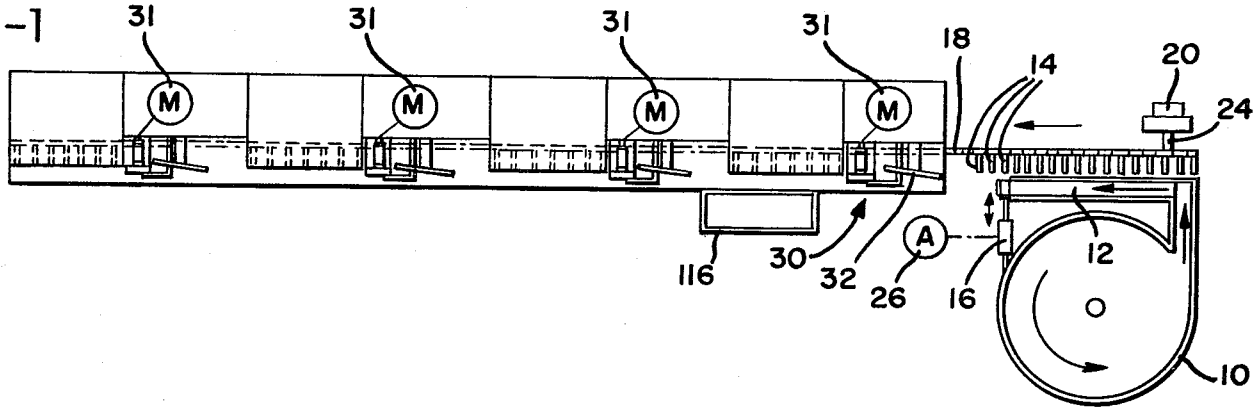
FIG. 1 is a top view of a coating apparatus used in the preferred embodiment of the invention.
Figure 2:
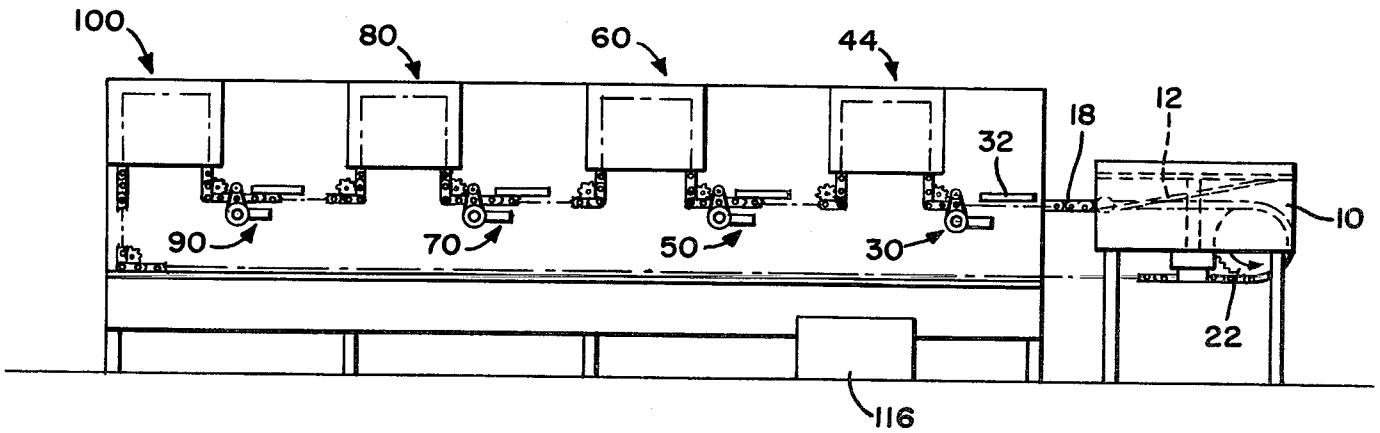
FIG. 2 is a front elevational of the apparatus of FIG. 1.

As illustrated in FIGS. 1 and 2, hollow cylindrical metal parts are automatically fed by a vibrating rotary feeder 10 to an inclined chute 12 where they are aligned in preparation for loading. The vibrating rotary feeder may be a Centron feeder available from the Materials Handling Equipment Division of the FMC Corporation, Homer City, Pa. Of course, other sutiable feeding devices may be utilized or the parts may be fed by hand to inclined chute 12.

At the base of inclined chute 12, the parts are automatically loaded onto mandrels 14 by a periodically operated pneumatic arm 16. Mandrels 14 are attached to and extend outwardly from endless chain 18 driven by sutiable means such as motor 20 connected to toothed gear 22 by shaft 24. As the chain is driven bringing mandrels 14 into alignment with the base of chute 12, a pulse of air under pressure from a source 26, which may be a cylinder of pressurized gas, causes arm 16 to move forward pushing a hollow part onto mandrel 14. Arm 16 then returns to its initial position permitting a next hollow part to move into position to be loaded when a succeeding mandrel reaches a point opposite the base of the chute. Control means (not shown) known in the art, time and control the movement of endless chain 18 and arm 16 so that loading of the parts proceeds automatically.

Figure 4:
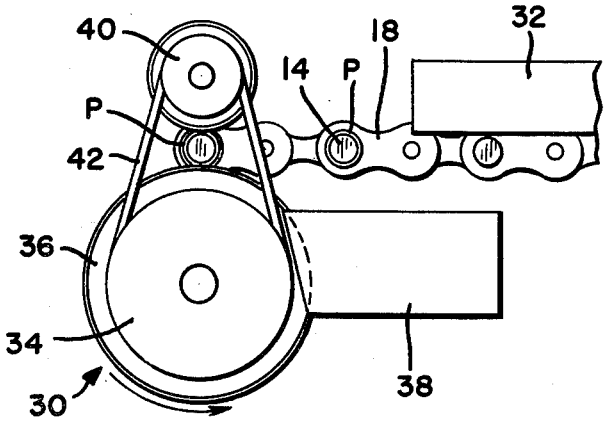
FIG. 4 is an enlarged front elevational view of the felt-covered drive wheel and idler wheel used to coat adhesive onto a metal part.

As the parts approach a first coating station 30, an angled guide means 32 positioned immediately above endless chain 18 acts to force the parts completely onto each mandrel 14. This ensures that the entire part will pass over the felt covered coating roller during the coating step. As best shown in FIG. 4, coating station 30 includes a motor 31 (shown in FIG. 1) engaging a drive roll 34 which is covered by a layer of natural fiber felt 36, a supply reservoir 38, an idler roll 40, and an endless belt 42 connecting the drive and idler rolls. The felt layer may be built up on roll 34 by pressing several thicknesses of felt pieces having a washer configuration onto the roll. The felt pieces may be cut from standard $\frac{3}{8}''$ or other suitable thickness flat stock. The use of all natural fiber felt avoids degradation problems while providing an excellent medium for transferring adhesive to a metal substrate.

In operation, a hollow cylindrical part P on mandrel 14 is conveyed by endless chain 18 between drive and idler rolls 34 and 40, respectively. Belt 42 serves both to drive idler roll 40 and to tension and press roll 40 against part P, and, thus press part P against felt layer 36. Adhesive suspended in an organic solvent such as xylene, toluene, or methyl isobutyl ketone in supply reservoir 38 is transferred onto felt layer 36 by a natural wicking action of the felt and impregnates layer 36 with an excess supply of adhesive. As part P is pressed and rotated between rolls 34 and 40, adhesive is expressed from felt layer 36 and uniformly transferred to the outer surface of part P. The diameters of the drive and idler rolls are sized sufficiently larger than the diameter of the parts to be coated so that the parts will complete at least one revolution while in contact with the rolls.

The freshly coated part is then conveyed to a first drying station 44. Drying station 44 comprises an enclosed elongated hood which contains a source of heat (not shown) and/or a fan or blower (not shown) to circulate air. It has been found that a drying temperature of from about 120° F. to 160° F. alone or in combination with the flow of air is sufficient to dry the adhesive coating in less than about 1 minute. Of course, the size of drying station 44, the temperature maintained therein, and the speed of movement of the coated parts through the station may all be varied depending upon the particular part and adhesive utilized.

In many cases, one coat of adhesive will be sufficient to improve the rubber to metal bonding properties of the part. However, in many other instances, multiple coats of adhesive and/or primer may be required. In the apparatus illustrated in FIGS. 1 and 2, four coating stations, 30, 50, 70, and 90, and four drying stations, 44, 60, 80, and 100, are shown. The structure and operation of the subsequent coating and drying stations is identical to that of coating station 30 and drying station 44. For the sake of brevity, they will not be discussed in further detail.

In a typical roller coating operation, it is desirable to build up a uniform coating of adhesive on a part to a thickness of from 0.001" to 0.6". A suitable adhesive for use in the practice of the present invention is Chemlok (trademark) 220, available from Hughson Chemical Company, Erie, Pa. This adhesive is nontacky when dry and is activated to bond with rubbers or other elastomers at high temperatures. If a primer is needed, Chemlok (trademark) 205, also available from Hughson Chemical Company, has been found to be suitable.

Figure 3A:
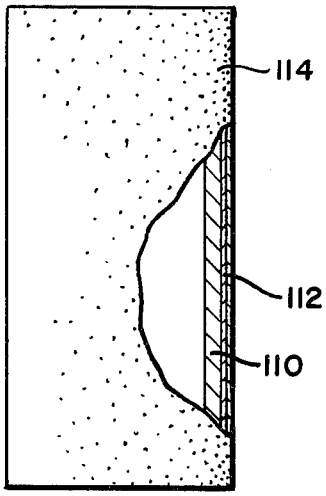
FIGS. 3*a* and 3*b* illustrate a metal part coated with adhesive according to the practice of the present invention.
Figure 3B:
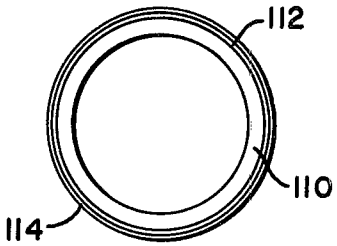

As illustrated in FIGS. 3*a* and 3*b*, a typical metal part 110 is coated with layers of primer 112 and adhesive 114 to form an intermediate product which is ready to be bonded with a variety of rubber or other elastomeric coatings. In a typical procedure, part 110 is initially coated with a layer of primer at coating station 30 and dried at station 44. A second layer of primer is applied at coating station 50 and the part dried again at station 60. The process is then repeated at stations 70, 80, 90, and 100 utilizing an adhesive coating to yield the intermediate product shown in FIGS. 3*a* and 3*b*. After a final drying at station 100, the coated parts are conveyed on endless chain 18 to a bin 116 where they are manually or automatically unloaded. Since the adhesive coating is nontacky when dry, the parts may be stored for extended periods of time before being bonded to a rubber or other elastomer.

While the apparatus and methods herein described constitute preferred embodiments of the invention, it is to be understood that the invention is not limited to those precise apparatus and methods, and that changes may be made in either without departing from the scope of the invention, which is defined in the appended claims.

What is claimed is:

1. Apparatus for uniformly coating a metal substrate with an adhesive comprising at least one coating station and at least one drying station, said coating station including a coating roll covered with an all natural fiber felt, means to rotate said coating roll, a reservoir means for supplying a solvent-based adhesive to said coating roll, and an idler roll adapted to be disposed on the opposite side of said metal substrate from said coating roll, and belt means connecting said idler roll to said coating roll for rotating said idler roll in the same direction as said coating roll and for pressing said metal substrate against said coating roll, said drying station including means to heat the air in said station, and means for conveying said metal substrate successively to said at least one coating station and at least one drying station said means for conveying comprising an endless chain having a mandrel extending outwardly from each link.

2. The apparatus of claim 1 including means for automatically feeding said substrate onto said conveyor means.

3. The apparatus of claim 2 in which said metal substrate is a hollow cylinder.

* * * * *